US005707422A

United States Patent [19]

Jacobsson et al.

[11] Patent Number: 5,707,422

[45] Date of Patent: Jan. 13, 1998

[54] METHOD OF CONTROLLING THE SUPPLY OF CONDITIONING AGENT TO AN ELECTROSTATIC PRECIPITATOR

[75] Inventors: Hans Jacobsson; Kjell Porle, both of Växjö , Sweden

[73] Assignee: ABB Fläkt AB, Stockholm, Sweden

[21] Appl. No.: 530,243

[22] PCT Filed: Feb. 25, 1994

[86] PCT No.: PCT/SE94/00158

§ 371 Date: Oct. 12, 1995

§ 102(e) Date: Oct. 12, 1995

[87] PCT Pub. No.: WO94/20218

PCT Pub. Date: Sep. 15, 1994

[30] Foreign Application Priority Data

Mar. 1, 1993 [SE] Sweden ..... 9300685
Aug. 4, 1993 [SE] Sweden ..... 9302557

[51] Int. Cl.[6] ..... B03C 3/013

[52] U.S. Cl. ..... 95/6; 95/7; 95/58; 95/71; 95/81; 96/22; 96/23; 96/52; 96/74

[58] Field of Search ..... 95/6, 7, 58, 71, 95/80, 81; 96/22–24, 52, 53, 74; 323/903; 364/148, 483

[56] References Cited

U.S. PATENT DOCUMENTS

| | | | |
|---|---|---|---|
| 1,909,825 | 5/1933 | Hahn et al. | 95/6 |
| 3,665,676 | 5/1972 | McKewen | 95/4 |
| 3,689,213 | 9/1972 | Guerrieri | 95/60 |
| 3,993,429 | 11/1976 | Archer | 431/5 |
| 4,052,177 | 10/1977 | Kide | 96/82 |
| 4,267,502 | 5/1981 | Reese et al. | 323/903 X |
| 4,311,491 | 1/1982 | Bibbo et al. | 323/903 X |
| 4,410,849 | 10/1983 | Ando | 323/903 X |
| 4,626,261 | 12/1986 | Jörgensen | 323/903 X |
| 4,770,674 | 9/1988 | Tellini et al. | 422/110 X |
| 4,779,207 | 10/1988 | Woracek et al. | 159/4.02 X |
| 4,987,839 | 1/1991 | Krigmont et al. | 110/345 X |
| 5,217,504 | 6/1993 | Johansson | 95/7 |
| 5,288,303 | 2/1994 | Woracek et al. | 95/6 X |
| 5,311,420 | 5/1994 | Zarfoss et al. | 364/148 |
| 5,477,464 | 12/1995 | Jacobsson | 364/483 |

FOREIGN PATENT DOCUMENTS

| | | | |
|---|---|---|---|
| 0 184 922 | 6/1986 | European Pat. Off. . | |
| 186338 | 7/1986 | European Pat. Off. | 95/81 |
| 3430016 | 3/1986 | Germany | 95/71 |
| WO 93/10902 | 6/1993 | WIPO . | |

*Primary Examiner*—Richard L. Chiesa
*Attorney, Agent, or Firm*—Burns, Doane, Swecker & Mathis, L.L.P.

[57] ABSTRACT

A method for use in an electrostatic precipitator unit, of controlling, with a view to cleaning an incoming dust-laden gas, the supply of conditioning agent to the incoming contaminated gas upstream of the precipitator unit. The precipitator unit includes discharge electrodes and collecting electrodes, between which a varying high voltage is maintained by means of a pulsating direct current supplied thereto. The frequency, the pulse charge and/or pulse length of the pulsating direct current are so varied that a plurality of frequency-charge-length combinations are obtained. For each combination, a figure of merit is measured or calculated. The figures of merit are used for establishing an optimal combination. The supply of conditioning agent is adjusted in dependence upon the pulse frequency of the established optimal combination.

13 Claims, 4 Drawing Sheets

Fig. 4a
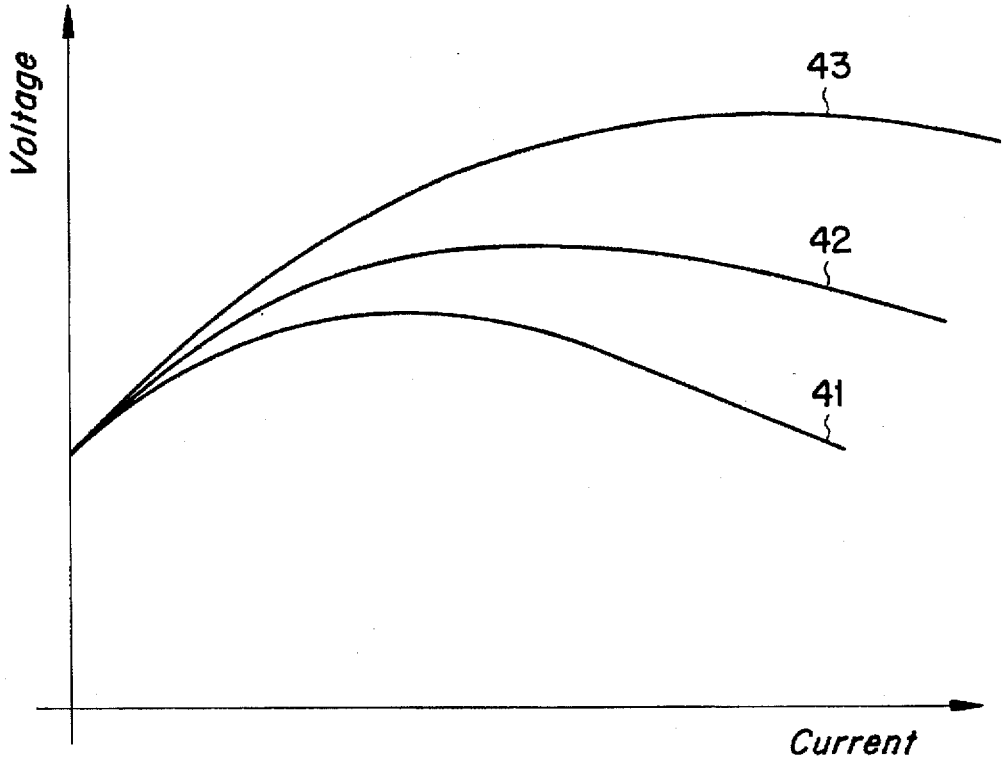
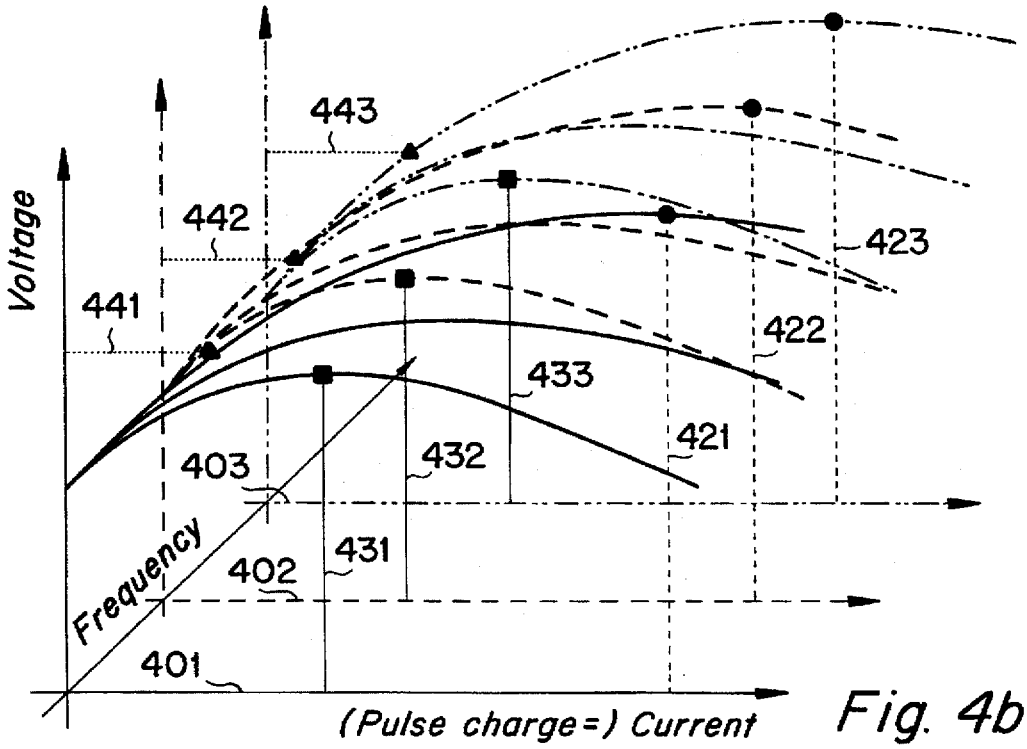
Fig. 4b

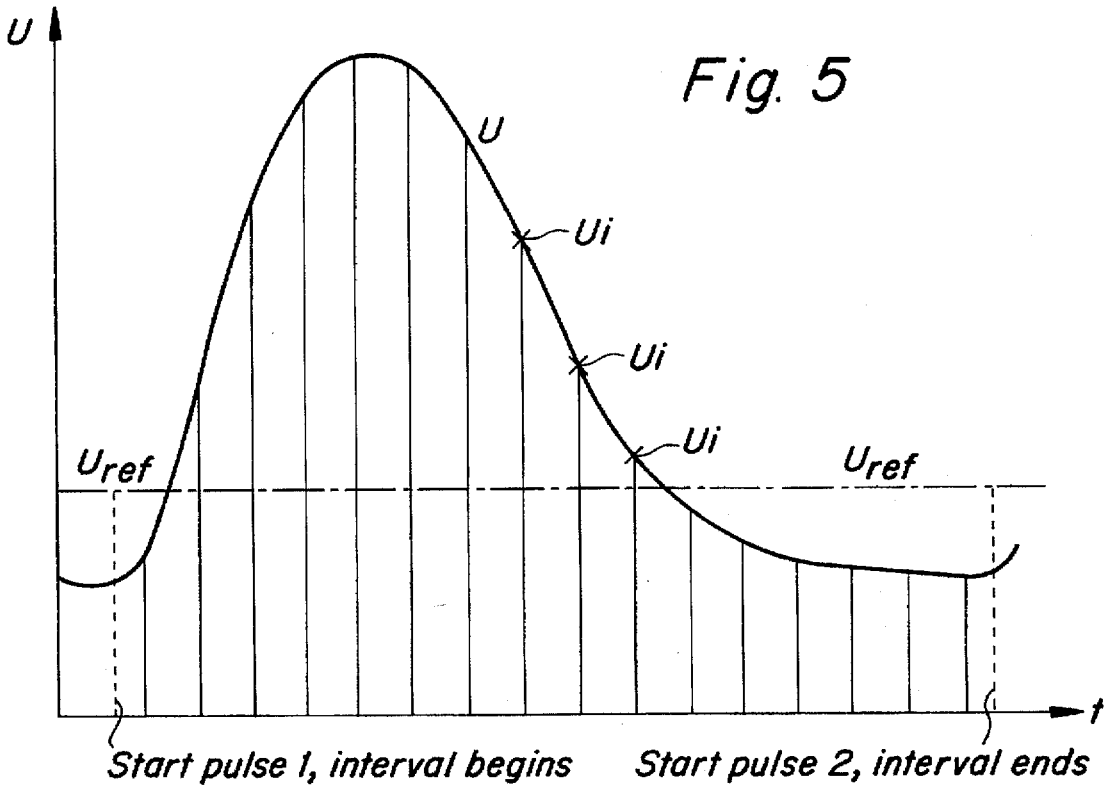
Fig. 5
Fig. 6
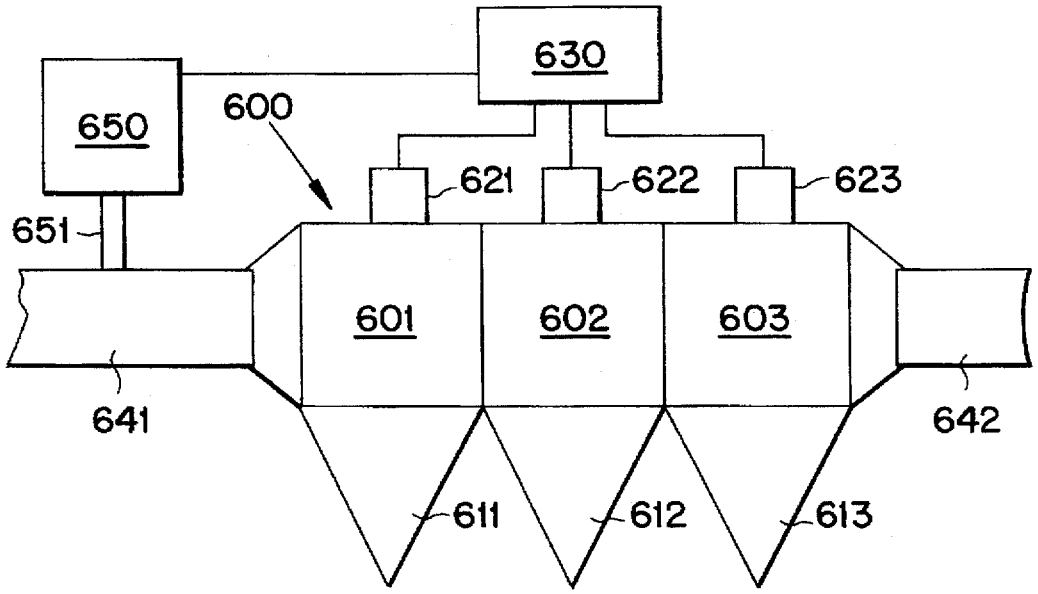

METHOD OF CONTROLLING THE SUPPLY OF CONDITIONING AGENT TO AN ELECTROSTATIC PRECIPITATOR

TECHNICAL FIELD

The present invention relates to a method for use in an electrostatic precipitator unit comprising discharge electrodes and collecting electrodes between which a varying high voltage is maintained by means of a pulsating direct current supplied thereto, of controlling, with a view to cleaning an incoming dust-laden gas, the supply of conditioning agent to the incoming dust-laden gas.

The method is especially well suited when the pulsating direct current has the form of a pulse train which is synchronised with the frequency of the mains voltage (e.g., a commercially available power supply) and in which the pulses are generated by supplying a part of a half wave of the mains voltage by means of a phase-angle-controlled rectifier (thyristor) after step-up transformation, to the electrodes of the precipitator, whereupon a plurality of periods of the mains voltage are allowed to pass without any current being supplied to the electrodes. A part of a half wave is thereafter again supplied, followed by a plurality of periods without any current, and so forth.

The method can be used both for optimizing the amount of conditioning agent and for tactical decisions of whether conditioning agent should be supplied at all.

TECHNICAL BACKGROUND

Electrostatic precipitators are often the most preferred dust separator option, especially for flue gas cleaning. They have a robust design and are highly reliable in operation. Moreover, they are very efficient, not seldom having a separation efficiency of above 99.9%. Since, as compared with textile barrier filters, electrostatic precipitators involve low costs of operation as well as a low risk of breakdown and stoppage owing to malfunction, they are the natural choice in many contexts.

When dust of high resistivity is to be separated, the comparison with textile barrier filters sometimes turns out different. In such cases of operation, it is often necessary, when using electrostatic precipitators, to operate with extremely unfavourable process parameters because of the risk of breakdowns in the dust layer building up on the collecting electrodes. This results in the emission of charges and dust from the collecting electrodes, what is generally known as back corona.

As early as the beginning of this century it was noted that additives could favourably affect The separation, e.g. by reducing the resistivity of the dust. The addition of water or sulphur trioxide is an example of this, and is discussed e.g. in U.S. Pat. No. 1,909,825 and U.S. Pat. No. 3,689,213.

To optimize operation and reduce energy consumption while improving the separation, several methods have been suggested for feeding current pulses to the filter. Examples of this are given in U.S. Pat. No. 4,052,177 and U.S. Pat. No. 4,410,849. The former publication suggests feeding pulses which are in the order of microseconds, which means that the rectifiers become very expensive. The latter publication suggests using pulses in the order of milliseconds, which can be achieved fairly easily by selectively controlling common thyristor rectifiers fed with alternating current of mains frequency.

The need to control the amount of conditioning agent is already disclosed in U.S. Pat. No. 1,909,825, proposing that an increasing current in the precipitator shall lead to reduced supply of water and, conversely, that a decreasing current shall lead to increased supply of water. Alternative embodiments consist of supplying liquid or superheated steam, optionally in combination with cold air. In special cases, heating or cooling, combined with the addition of conditioning agent, may prove suitable.

More recent control principles are based on a number of measuring parameters. U.S. Pat. No. 4,779,207 suggests adding conditioning agent so as to maintain the power fed to the precipitator constant. In U.S. Pat. No. 3,665,676, the amount of conditioning agent is directly related to the gas flow. U.S. Pat. No. 3,993,429 suggests making the amount of conditioning agent supplied dependent on the amount of fuel, coal, that is supplied to the furnace, where the dust-laden gas originates. U.S. Pat. No. 4,770,674 gives a very broad, but unspecified reference to "at least one operative parameter in the industrial plant concerned corresponding to the demand made on the electrostatic precipitator", as well as a few specific examples of parameters under consideration, e.g., temperature, gas flow, fan speed, opacity in the chimney and useful electrical power fed to the precipitator.

Irrespective of the technique selected, this should of course be used with the highest possible efficiency and profitability. This applies to the electrical parameters as well as the conditioning control. First and foremost, the emissions should be below the set limit values. Second, the cost therefor should be minimised.

With the new techniques, the number of control parameters has increased and, hence, the complexity of the control systems. Regrettably, this also means that the adjustment itself increases the interference in the separator function. In the same way as the emissions increase when the filter is rapped, the emissions will increase during the time the adjustment proceeds or the set control parameters are being checked.

If the adjustment is performed manually on the basis of the indication on an opacimeter (smoke densimeter), such a long time is required for the adjustment that, under varying operating conditions, very considerable emissions may very well be produced during the adjustment proper, which make up a substantial part of the total emissions. Besides, operational variations may affect the adjustment so that the optimization will fail if considerable changes in dust concentration or gas temperature occur during the time required for the adjustment. This applies even to the adjustment of the electrical parameters and is a still more difficultly-mastered problem when adjusting the supply of conditioning agent, since the time constant of the system may then range from minutes to hours. Especially when there is a decrease in the amount of conditioning agent, it will take quite long before the consequences thereof can be established. In addition, the effect will be delayed in the later sections, if several precipitator sections are connected in series.

It therefore is highly desirable to provide a method for quickly and reliably detecting the status of a precipitator with a view to adjusting the amount of conditioning agent supplied. Preferably, this adjustment should be based only on electrical measurements in the very precipitator or the associated rectifier. This is so, among other things, because it has been found that even if the rapping of a filter section considerably affects the dust concentration of the gas leaving the precipitator and, hence, the signal from an optional smoke densimeter, the current-to-voltage ratio in the precipitator is only marginally changed thereby.

OBJECT OF THE INVENTION

The methods hitherto tested for controlling the supply of conditioning agent when separating highly resistive dust have been found not always to yield the optimum parameter combination and, above all, they are far too slow. Considerable gains in the form of lower emissions, reduced consumption of conditioning agent and reduced energy consumption can be obtained from a changed evaluation of the operational conditions. This is so particularly in comparison with methods based on measurement of the dust concentration, but it also applies to hitherto proposed methods that are based on controlling after measurement of electrical quantities.

It therefore is a main object of the present invention to provide an improved method for controlling the supply of conditioning agent to electrostatic precipitators when separating "difficult" dust, for example dust having high resistivity. The purpose of such a method is to economise on conditioning agent or on energy or to permit choosing a combination which in a given situation optimizes the consumption of energy and conditioning agent for minimising costs.

Another object of the present invention is to provide a method which makes it easier than hitherto known methods to follow operational variations with an amount of conditioning agent adjusted to each operational event, or at least give clear indications of when and in which direction a change is to be made, so as to reduce the risk of overdosage of conditioning agent with the ensuing risk of environmental disturbance and corrosion because of an unnecessarily low pH in the gas ducts.

SUMMARY OF THE INVENTION

The present invention relates to a method for use in an electrostatic precipitator unit comprising discharge electrodes and collecting electrodes between which a varying high voltage is maintained by means of a pulsating direct current supplied thereto, of controlling, with a view to cleaning an incoming dust-laden gas, the supply of conditioning agent to the incoming contaminated gas upstream of the precipitator unit. The frequency, the pulse charge and/or the pulse length of the pulsating direct current are varied so as to obtain a plurality of frequency- charge-length combinations. A figure of merit is measured or calculated for each combination. The figures of merit are used to establish an optimal combination. The supply of conditioning agent is controlled in dependence on the pulse frequency for the established optimal combination.

GENERAL DESCRIPTION OF THE INVENTION

It has been known for over 50 years that the supply of conditioning agent to a dust-laden gas upstream of an electrostatic precipitator often improves the performance of the precipitator. This is especially evident when the dust is difficult to separate, i.e. is highly resistive. As mentioned above, this has resulted in the development of many conditioning techniques. Moreover, attempts have been made for the same purpose, sometimes with highly complex equipment, to supply the required energy to the separator, using also very short pulses.

Gradually, it was found that excellent results were had also with pulses of the same order as the half waves of the regular alternating voltage used in the distribution networks. See, for example, the above-mentioned U.S. Pat. No. 4,410,849. This insight was however available long before that.

Combinations of pulse technique and conditioning with a view to improving the performance of a precipitator are not yet very common, but since these methods can supplement each other, such a combination may confer advantages both in terms of environment and economy. One example of a combined control technique is given in U.S. Pat. No. 4,987,839.

To achieve the contemplated purpose, the proposed method consists of analysing the electrical parameters of the precipitator and, on the basis thereof, drawing conclusions about the suitable amount of conditioning agent. The method here suggested means that, under given and as far as possible constant conditions, a purely electrical optimization is performed so as to obtain optimum values of pulse frequency, pulse-charge and pulse length. The pulse frequency obtained in the set optimal combination is thereafter used as control parameter for the supply of conditioning agent.

The electrical optimization may take place in many different ways. It is suggested to be performed by giving each combination of pulse frequency, pulse charge and pulse length a figure of merit by measurement and optional calculation.

An example of a figure of merit is a peak value, a mean value or a bottom value of the voltage between the electrodes of the precipitator. Such a method is disclosed in U.S. Pat. No. 4,311,491.

It may also advantageously be a value established on more sophisticated grounds, such as the quotient of peak voltage and pulse charge, optionally when one of these parameters is maintained constant during the adjustment. This is suggested in EP-0 184 922.

The method described in the latter two patents means that a figure of merit will not be related to each conceivable parameter combination, since these methods already contain one condition for a maximum value or a minimum value and thus assigns a first selection principle. When these methods are used for feeding pulses to an electrostatic precipitator by means of phase-angle-controlled rectifiers, one will arrive at a figure of merit for each pulse frequency by a variation of the size of the pulses, whereupon the figures of merit obtained are compared for selection of the optimum frequency.

A suitable and efficient method for determining a figure of merit where each parameter combination can be reflected by an individual figure of merit is, as suggested in PCT/SE92/00815, to establish a reference voltage level $U_{ref}$, generally between a peak value and a bottom value of the voltage between the discharge electrodes and the collecting electrodes, and to assign to the time during which the voltage is exceeding this level, a positive value and to assign to the time during which the voltage is falling below this level, a negative value. Such assigning is preferably done with a weighting according to the function $A=U\cdot(U-U_{ref})$, where U is the voltage prevailing at a certain point of time between the electrodes in the precipitator.

For evaluating the pulse by assigning some form of unambiguous measuring value, the function A can be integrated during a defined time interval or, in sampled measurement, a suitably weighted summation of $A_i$ can take place during a defined time interval, suitably such that some form of a mean value is formed or a numerical approximation of integration takes place.

With this technique, the effect of the deleterious current which depends on back corona from the collecting electrodes can be evaluated and minimised by means of the proposed method.

The choice of the reference voltage $U_{ref}$ highly influences the evaluation according to the proposed method. For a satisfactory operational optimization, it is necessary that $U_{ref}$ be selected close to the voltage at which the corona discharge at the discharge electrodes commences.

The length of the time interval during which the pulse is evaluated is not as critical as the value of the reference voltage $U_{ref}$. According to the proposed method, the time interval during which the evaluation takes place preferably is the time interval during which the corona discharge takes place at the discharge electrodes.

After a purely electrical optimization by varying the pulse parameters, the set optimum pulse frequency is used in the method here proposed, for deciding how the supply of conditioning agent is to be changed. Usually, this means an increase of the amount of conditioning agent if the optimum pulse-frequency is very low, and a decrease of the amount of conditioning agent if the optimum pulse frequency is very high. Thus, it is possible to make an adjustment towards a desired value of the pulse frequency or towards a desired interval of the pulse frequency. The pulse frequency thus serves as an intermediate parameter for adjusting the amount of conditioning agent.

Usually, the conditioning agent is supplied only in one position upstream of the precipitator also when this is divided into a plurality of series-connected and/or parallel-connected sections. When evaluating the effect of the conditioning on the conditions in the precipitator and, hence, on the degree of separation, a plurality of signals must therefore be evaluated and a decision principle be established. This may be effected by letting the precipitator section which reports the poorest status be decisive, but, as a rule, is more likely to be decided by the condition prevailing in one of the upstream sections because the last sections, as seen in the direction of flow, also exhibit the most delayed effect. Thus, a decision about the amount of conditioning agent is preferably made on the basis of the condition in the first or the second section while in the others only an electrical optimization takes place according to the proposed method.

To avoid a substantial overdosage in the event of operational disturbance in one of the precipitator sections that are allowed to affect controlling, the plant should be provided with some kind of monitoring of exiting gas, such that an indication is given if the content of conditioning agent in the emissions increases or exceeds a given limit value.

If the operation need not be one to obtain a maximum degree of separation, but the intention merely is to be below the emission values established by the authorities, the method is a powerful aid in minimising operational costs. The cost of conditioning has a most significant impact on the overall economy of the plant.

BRIEF DESCRIPTION OF THE DRAWINGS

The invention will now be described in more detail with reference to accompanying drawings, in which

FIGS. 4*a* and 4*b* show the basic relationship between the mean value of the current through a precipitator and the respective peak value, mean value and bottom value of the voltage between the electrodes of the precipitator at operational conditions where breakdowns in a separated dust layer may occur;

FIG. 5 shows a method of evaluating the voltage between the electrodes of a precipitator; and FIG. 6 is a simplified view showing a plant for carrying out the inventive method of controlling the supply of conditioning agent.

DESCRIPTION OF THE PREFERRED EMBODIMENT

Figure 1A:
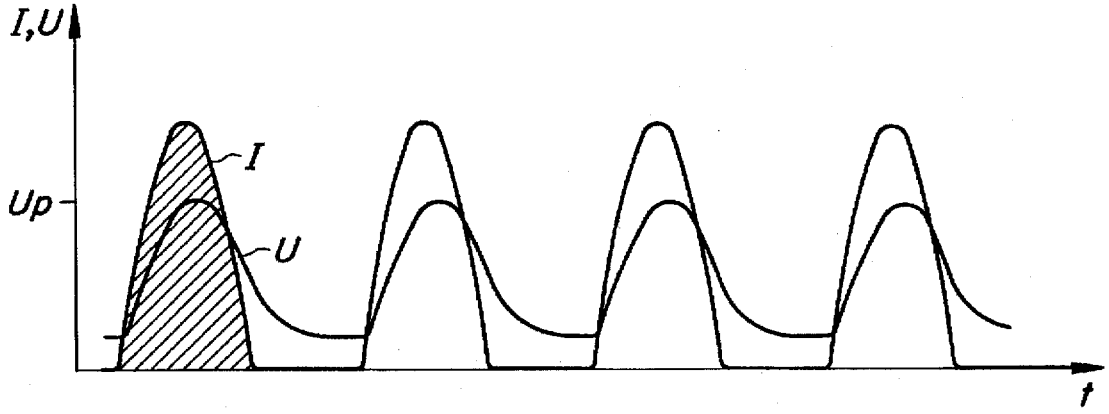
FIGS. 1*a* and 1*b* show the basic relation between current and voltage as a function of time in an electrostatic precipitator.
Figure 1B:
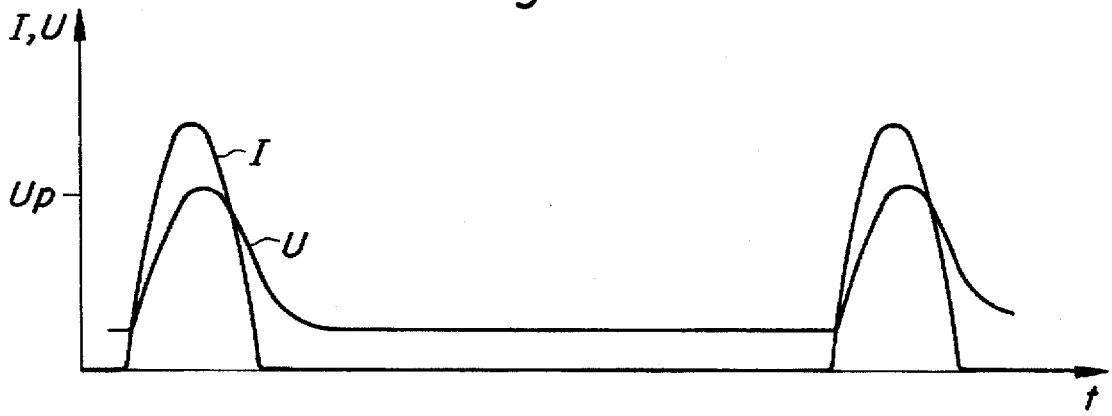

FIG. 1*a* shows the general relation between current and voltage in an electrostatic precipitator supplied with current from a phase-angle-controlled rectifier (thyristor rectifier) when the thyristors are turned on in all the half periods of the alternating current. FIG. 1*b* shows the same relation when the thyristors are turned on only in each third half period. In general, the method of the present invention will be used at essentially lower turn-on frequencies than those shown, which for reasons of clarity are not drawn to scale. Therefore, the relationship between the levels also is of no relevance whatever.

Figure 2:
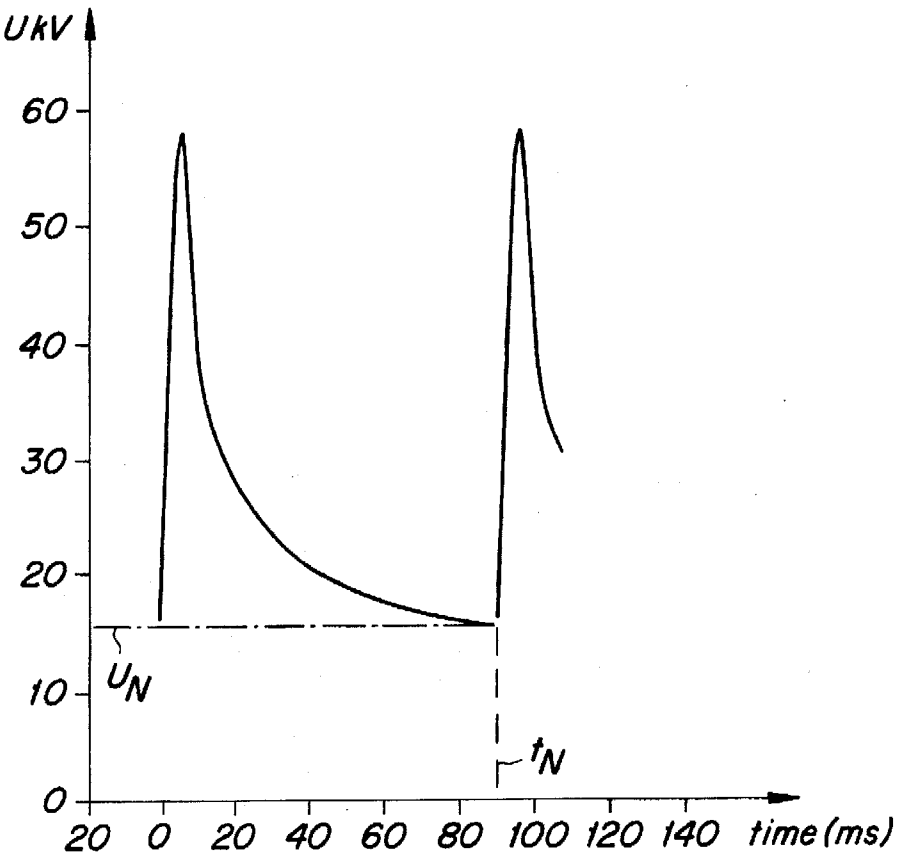
FIG. 2 shows the measured voltage as a function of time in an electrostatic precipitator fed with current pulses having a frequency of about 11 Hz.

FIG. 2 shows the voltage actually measured in a more realistic situation where the thyristors are turned on in every ninth half period, then giving a very steep voltage increase, whereupon it first drops very steeply and then increasingly slowly. The great difference between the peak value and the bottom value of the voltage between the electrodes is quite realistic. The change of scale makes comparisons with the previous Figure inappropriate. In FIG. 2, the peak value of the voltage is about 58 kV and the bottom value of the voltage about 16 kV.

If the turn-on angles of the thyristors are varied at a constant frequency, both the peak and the bottom values of the voltage will vary. Under favourable operational conditions or close to optimum operation, the bottom value is relatively independent of the turn-on angle while the peak value rises monotonously with decreasing turn-on angle, i.e. increased conduction time for the thyristors. Under severe operational conditions and during operation with unsuitable parameters, the bottom voltage decreases even at a low current with decreasing turn-on angle, and at higher currents both the mean value and the peak value of the voltage decrease.

Figure 3:
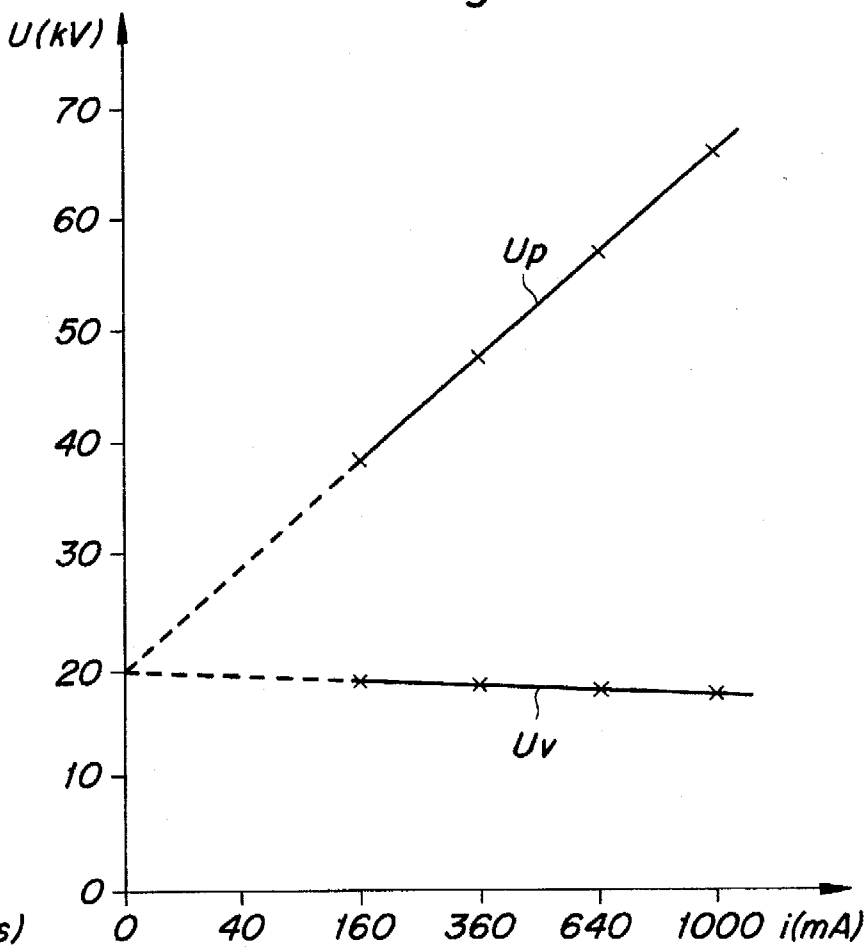
FIG. 3 shows the peak value and the bottom value of the voltage between the electrodes in an electrostatic precipitator at a constant pulse frequency as a function of the square root of the mean value of the current through the precipitator.

FIG. 3 illustrates the relationships actually measured for a certain pulse frequency at close to optimum operation.

FIG. 4 shows the basic relation between current and voltage in a precipitator when separating dust of high resistivity. FIG. 4*a* shows an imaginary relation corresponding to the pulse train in FIG. 1, i.e. when the pulses are generated by applying a part of each half wave on the regular AC mains to the rectifier of the precipitator. The curves 41, 42, 43 correspond to the bottom value 41, the mean value 42 and the peak value 43 for the voltage between the electrodes of the precipitator. All three curves show a local maximum. This can be seen as an example of electrical parameters indicating optimum operation. In this operational case, the frequency is constant and equal to double the mains frequency.

FIG. 4*b* shows three series of curves corresponding to the only one in FIG. 4*a*. These curves have been obtained by varying the pulse frequency. For the sake of clarity, a frequency axis has been drawn as a third dimension and the curves have been traced in different coordinate systems 401, 402, 403 with depth effect. In the following description, the current axis is assumed to be differently graduated for the different coordinate systems 401–403 in depth so as to have a graduation corresponding to the pulse charge concerned rather than the mean value of the current.

Further, FIG. 4*b* has traced therein examples of how to establish the figures of merit concerned for a certain pulse frequency obtained by the thyristors of the rectifier being not turned on in each half period but with a plurality of currentless periods following upon each half period during which current is supplied to the precipitator. The dashed lines 421, 422, 423 show the maximum peak voltage for the pulse frequency concerned when varying only the conduction time of the thyristors. The full lines 431, 432, 433 show, under the same conditions, the maximum bottom voltage. The dotted lines 441, 442, 443 indicate the supplied pulse charge at a given peak value of the voltage. This constant peak value 441–443 must fall considerably below the corresponding maximum peak value 421–423.

FIG. 5 illustrates another method of establishing the figure of merit for a certain parameter combination. This Figure shows, with a slight distortion for greater clarity, how the voltage between the electrodes of the precipitator varies with time during the interval from one current pulse start to the start of the next current pulse. It is there also intimated that the measurement of the voltage between the electrodes of the precipitator takes place at a plurality of discrete, uniformly distributed points of time. In the practical case, measurement takes place at essentially more points of time than those shown, e.g. 1–3 times per millisecond. These measuring values are stored in a control unit 630, preferably computerized, and $A_i=U_i\cdot(U_i-U_{ref})$ is calculated for each measuring point by means of the value of $U_{ref}$ likewise stored in the control unit 630.

The integral $I_k=\int U\cdot(U-U_{ref})\cdot dt$ is thereafter evaluated numerically for the whole interval by differential summation of $A_i$ calculated according to the above, multiplied by the time difference between two discrete measurements. The differences in time are here constant. This calculation is performed automatically in the control unit 630 and the result is stored as a "figure of merit" for the combination concerned of pulse frequency and turn-on angle for the thyristors in the respective rectifier 621, 622, 623.

It is here assumed that the pulse frequency is not too low. At frequencies lower than 10 Hz, it is suggested that an evaluation takes place during an interval which is shorter than the time between the start of two consecutive pulses. This can be done either by determining a value of the interval which is fixed for each frequency, and storing it in the control unit 630 or by determining the length of the interval by evaluating the decrease of the voltage.

FIG. 6 schematically shows a plant for carrying out the inventive method. A precipitator 600 having an inlet channel 641 and an outlet channel 642 comprises three sections 601, 602, 603, each having a dust hopper 611, 612 and 613, respectively, the sections being supplied with pulsating direct current from three rectifiers 621, 622 and 623, respectively. The rectifiers 621–623 are controlled and monitored by a control unit 630. The control unit 630 also communicates with a device 650 for supplying conditioning agent to the inlet channel 641 of the precipitator 600 via a conduit 651.

In the proposed method, the gas fed through the inlet channel 641 is supplied with a constant amount of conditioning agent from the device 650 via the conduit 651. The rectifier 621 feeds, with parameters varying according to a predetermined principle, a pulsating direct current to the electrodes (not shown) of the section 601. The control unit 630 evaluates the pulse-shaped current supplied and the appearing voltage, and calculates a figure of merit for each combination of parameters or for each group of combinations. According to a predetermined strategy, a selection is made on the basis of these figures of merit of the parameter combination which for the supply of conditioning agent concerned can be considered to be the electrically optimal one, and operation continues with this established parameter combination.

If this optimal parameter combination assigns a frequency above 10 Hz, the supply of conditioning agent ceases completely. If the frequency assigned falls below 1 Hz, the supply of conditioning agent is increased. If the frequency assigned falls below 0.3 Hz, the supply is heavily increased. A suitable adjusting strategy must be based on a certain experience of the plant concerned and optionally also of the dust contained in the gas to be cleaned.

An electrical optimization of the current supply to all three sections 601, 602, 603 takes place at short intervals. This is initiated and evaluated by the control unit 630.

For the downstream sections 602, 603, only an optimization of the electrical parameters takes place. The control of the amount of conditioning agent is done on the basis of an evaluation of the status of the first section 601.

After a predetermined time, which is determined on the basis of the setting time after changing the supply of conditioning agent, a repeated evaluation is carried out with a view to again adjusting the amount of conditioning agent. This can also be done after an alarm received from optional monitoring sensor means (not shown) for detecting the amount of dust or conditioning agent in the outlet 642 of the precipitator.

ALTERNATIVE EMBODIMENTS

The method according to the invention is of course not restricted to the embodiment described above but can be modified in several different ways within the scope of the accompanying claims.

The method is entirely independent of how the conditioning is performed technically. It can be applied also when a chemical change of all the gas or of a partial gas flow is effected in order to produce the substance which gives the desired improvement of the separation efficiency. It can be used in cooling alone as well as when adding sulphur trioxide, ammonia or ammonium sulphate.

The method can be applied to several other methods of supplying current in the form of pulses to electric precipitators. Examples of such methods are pulse-width-modulated high frequency and other forms of so-called switched-mode technique, as well as the use of "turn-off" thyristors. The method is also well suited for use in the very special pulse rectifiers which generate pulses in the order of microseconds even if this may entail technical difficulties in the measuring operation.

We claim:

1. A method for use in an electrostatic precipitator unit comprising discharge electrodes and collecting electrodes between which a varying high voltage is maintained by means of a pulsating direct current supplied thereto, said method controlling, for cleaning an incoming dust-laden gas, the supply of conditioning agent to said incoming dust-laden gas upstream of the precipitator unit, comprising of the steps of varying the frequency, the pulse charge and/or the pulse length of said pulsating direct current, so as to obtain a plurality of frequency-charge-length combinations;

measuring or calculating a figure of merit for each combination, or for a defined group of combinations;

using the figures of merit for establishing an optimal combination; and adjusting the supply of conditioning agent in dependence on the pulse frequency of the established optimal combination, wherein the figure of merit is determined by varying the frequency, the pulse charge and/or the pulse length of the pulsating direct current, so as to obtain a plurality of frequency-charge-length combinations;

measuring for each of these combinations the voltage U between discharge electrodes and collecting electrodes;

establishing, measuring or calculating for each of these combinations a voltage value $U_{ref}$;

effecting, for each of these combinations, either a measurement or a calculation of the integral $I_k=\int U\cdot(U-U_{ref})\cdot dt$ during a defined time interval, or a measurement and a calculation of $A_i=U_i\cdot(U_i-U_{ref})$ at a number of times "i" within a defined time interval; and using $I_k$ or linear combinations of $A_i$ as figures of merit for the frequency-charge-length combination of the pulsating direct current.

2. A method as claimed in claim 1, wherein $U_{ref}$ is set approximately equal to the ignition voltage of the corona discharge, and wherein the defined time interval is set equal to or substantially equal to the time during which the corona discharge takes place during a current pulse.

3. A method as claimed in claim 1, wherein the supply of conditioning agent is changed if the pulse frequency for the established optimal combination falls outside a predetermined interval.

4. A method as claimed in claim 1, wherein the supply of conditioning agent is changed if the pulse frequency for the established optimal combination falls outside a predetermined interval, and wherein the supply of conditioning agent is reduced if the pulse frequency for the established optimal combination exceeds a predetermined limit value.

5. A method for use in an electrostatic precipitator unit comprising discharge electrodes and collecting electrodes between which a varying high voltage is maintained by means of a pulsating direct current supplied thereto, said method controlling, for cleaning an incoming dust-laden gas, the supply of conditioning agent to said incoming dust-laden gas upstream of the precipitator unit, comprising of the steps of varying the frequency, the pulse charge and/or the pulse length of said pulsating direct current, so as to obtain a plurality of frequency-charge-length combinations;

measuring or calculating a figure of merit for each combination, or for a defined group of combinations;

using the figures of merit for establishing an optimal combination; and adjusting the supply of conditioning agent in dependence on the pulse frequency of the established optimal combination, wherein the figure of merit is determined by maintaining the frequency of the pulsating direct current constant while varying the pulse charge and/or the pulse length so as to obtain a plurality of charge-length combinations, and using the maximum value of the bottom value, the mean value and/or the peak value of the voltage as a figure of merit for the frequency concerned.

6. A method as claimed in claim 5, wherein the supply of conditioning agent is changed if the pulse frequency for the established optimal combination falls outside a predetermined interval.

7. A method as claimed in claim 5, wherein the supply of conditioning agent is changed if the pulse frequency for the established optimal combination falls outside a predetermined interval, and wherein the supply of conditioning agent is reduced if the pulse frequency for the established optimal combination exceeds a predetermined limit value.

8. A method for use in an electrostatic precipitator unit comprising discharge electrodes and collecting electrodes between which a varying high voltage is maintained by means of a pulsating direct current supplied thereto, said method controlling, for cleaning an incoming dust-laden gas, the supply of conditioning agent to said incoming dust-laden gas upstream of the precipitator unit, comprising of the steps of varying the frequency, the pulse charge and/or the pulse length of said pulsating direct current, so as to obtain a plurality of frequency-charge-length combinations;

measuring or calculating a figure of merit for each combination, or for a defined group of combinations;

using the figures of merit for establishing an optimal combination; and adjusting the supply of conditioning agent in dependence on the pulse frequency of the established optimal combination, wherein the figure of merit is determined as the quotient between the peak value of the voltage between the electrodes of the precipitator, and the pulse charge, and wherein a comparison with other frequencies is performed either at a constant pulse charge or at a constant peak voltage.

9. A method as claimed in claim 8, wherein the supply of conditioning agent is changed if the pulse frequency for the established optimal combination falls outside a predetermined interval.

10. A method as claimed in claim 8, wherein the supply of conditioning agent is changed if the pulse frequency for the established optimal combination fails outside a predetermined interval, and wherein the supply of conditioning agent is reduced if the pulse frequency for the established optimal combination exceeds a predetermined limit value.

11. A method for use in an electrostatic precipitator unit comprising discharge electrodes and collecting electrodes between which a varying high voltage is maintained by means of a pulsating direct current supplied thereto, said method controlling, for cleaning an incoming dust-laden gas, the supply of conditioning agent to said incoming dust-laden gas upstream of the precipitator unit, comprising of the steps of varying the frequency, the pulse charge and/or the pulse length of said pulsating direct current, so as to obtain a plurality of frequency-charge-length combinations;

measuring or calculating a figure of merit for each combination, or for a defined group of combinations;

using the figures of merit for establishing an optimal combination: and adjusting the supply of conditioning agent in dependence on the pulse frequency of the established optimal combination, wherein the figure of merit is determined by maintaining the frequency of the pulsating direct current constant while varying the pulse charge and/or the pulse length so as to obtain a plurality of charge-length combinations, and using the pulse charge at a given level for the peak value of the voltage between the electrodes of the precipitator, which level should fall significantly below the maximum value of the voltage at the frequency concerned, as figure of merit for said frequency.

12. A method as claimed in claim 11, wherein the supply of conditioning agent is changed if the pulse frequency for the established optimal combination falls outside a predetermined interval.

13. A method as claimed in claim 11, wherein the supply of conditioning agent is changed if the pulse frequency for the established optimal combination falls outside a predetermined interval, and wherein the supply of conditioning agent is reduced if the pulse frequency for the established optimal combination exceeds a predetermined limit value.

* * * * *